US010012033B2

(12) United States Patent
Schultz et al.

(10) Patent No.: US 10,012,033 B2
(45) Date of Patent: Jul. 3, 2018

(54) CONNECTION APPARATUS FOR COILED TUBING AND METHOD OF ATTACHING SAME

(71) Applicants: Roger Schultz, Newcastle, OK (US); Brett Fears, Oklahoma City, OK (US)

(72) Inventors: Roger Schultz, Newcastle, OK (US); Brett Fears, Oklahoma City, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 462 days.

(21) Appl. No.: 14/326,085

(22) Filed: Jul. 8, 2014

(65) Prior Publication Data

US 2015/0060087 A1 Mar. 5, 2015

Related U.S. Application Data

(60) Provisional application No. 61/870,604, filed on Aug. 27, 2013.

(51) Int. Cl.
*E21B 17/04* (2006.01)
*E21B 17/20* (2006.01)
*E21B 17/02* (2006.01)

(52) U.S. Cl.
CPC ..... *E21B 17/026* (2013.01); *E21B 17/04* (2013.01); *E21B 17/20* (2013.01); *Y10T 29/49915* (2015.01)

(58) Field of Classification Search
CPC ..... E21B 17/04
USPC ..... 285/242, 271
See application file for complete search history.

(56) References Cited

U.S. PATENT DOCUMENTS 1,971,105 A * 8/1934 Hartman ..... F16L 33/221 285/243
3,140,884 A * 7/1964 Brauck ..... F16L 33/22 285/242
3,687,491 A * 8/1972 Marshall ..... F16L 37/138 285/242

(Continued)

FOREIGN PATENT DOCUMENTS

EP 0681085 A2 11/1995

OTHER PUBLICATIONS

International Search Report and Written Opinion; PCT/US2014/052518; dated Nov. 28, 2014; 10 pages.

*Primary Examiner* — Giovanna Collins Wright
(74) *Attorney, Agent, or Firm* — Hall Estill Law Firm

(57) ABSTRACT

This disclosure is directed to a connector apparatus for a semi-flexible tubing. The connector apparatus includes an inner sub having a first end disposable within a semi-flexible tubing and a second end connectable to various other downhole tools. The first end of the inner sub includes at least one depression disposed thereon that is generally alignable with at least one depression disposed on the semi-flexible tubing. The connector apparatus also includes an external sleeve disposable outside of the semi-flexible tubing. The external sleeve having at least one opening disposed therein generally aligned with the at least one depression in the first end of the inner sub. This disclosure is also directed to a method of installing the connector apparatus on a semi-flexible tubing and a method of running the semi-flexible tubing and a downhole tool into a wellbore via the connector apparatus disclosed herein.

20 Claims, 1 Drawing Sheet

(56) References Cited

U.S. PATENT DOCUMENTS

| | | | | |
|---|---|---|---|---|
| 4,486,035 | A * | 12/1984 | Storke | F16L 33/22 285/242 |
| 4,486,036 | A * | 12/1984 | Storke | F16L 33/22 285/242 |
| 5,957,209 | A | 9/1999 | Burleson et al. | |
| 6,338,504 | B1 | 1/2002 | Hilliard | |
| 6,474,701 | B1 * | 11/2002 | Bowles | B21D 39/04 285/256 |
| 2006/0283606 | A1 | 12/2006 | Partouche | |
| 2008/0245570 | A1 | 10/2008 | Partouche | |
| 2011/0284224 | A1 * | 11/2011 | Misselbrook | E21B 29/00 166/298 |
| 2013/0180707 | A1 * | 7/2013 | Bucher | E21B 17/04 166/242.2 |

* cited by examiner

CONNECTION APPARATUS FOR COILED TUBING AND METHOD OF ATTACHING SAME

CROSS-REFERENCE TO RELATED APPLICATIONS

The present application is a conversion of U.S. Provisional Application having U.S. Ser. No. 61/870,604, filed Aug. 27, 2013, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

SUMMARY OF THE DISCLOSURE

This disclosure is directed to a connector apparatus for a semi-flexible tubing. The connector apparatus includes an inner sub having a first end disposable within a semi-flexible tubing and a second end connectable to various other downhole tools. The first end of the inner sub includes at least one depression disposed thereon that is generally alignable with at least one depression disposed on the semi-flexible tubing. The connector apparatus also includes an external sleeve disposable outside of the semi-flexible tubing. The external sleeve having at least one opening disposed therein generally aligned with the at least one depression in the first end of the inner sub.

This disclosure is also directed to a method of installing the connector apparatus on a semi-flexible tubing. The disclosure is further directed toward a method of running the semi-flexible tubing and a downhole tool into a wellbore via the connector apparatus disclosed herein.

DETAILED DESCRIPTION OF THE DISCLOSURE

Figure 1:
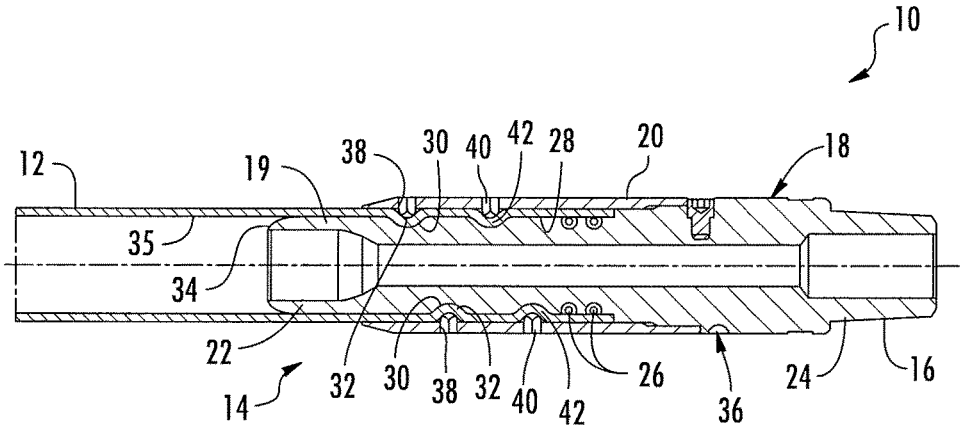
FIG. 1 is a cross-sectional view of a downhole tool constructed in accordance with the present disclosure.
Figure 2:
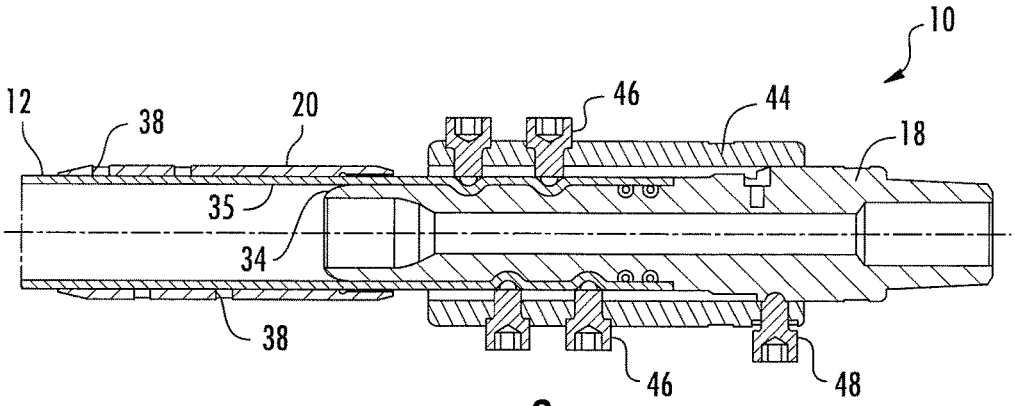
FIG. 2 is a cross-sectional view of the downhole tool constructed in accordance with the present disclosure.

The present disclosure relates to a connector apparatus 10 securable to semi-flexible tubing 12 (such as coiled tubing) and attachable to downhole tools used in oil and gas operations. The connector apparatus 10 is configured to be securely supported by and/or attached to the semi-flexible tubing 12 on a first end 14 and connectable to various downhole tools on a second end 16.

The connector apparatus 10 includes an inner sub 18 having a portion 19 disposed within the semi-flexible tubing 12 and an external sleeve 20 disposed outside of the semi-flexible tubing 12. The inner sub 18 has a first end 22 sized to fit inside the semi-flexible tubing 12 and a second end 24 configured to be connectable to downhole tools. In one embodiment, the inner sub 18 can also include at least one sealing member 26 disposed around an outer portion 28 of the first end 22 of the inner sub 18 to prevent leaking between the semi-flexible tubing 12 and the inner sub 18. In another embodiment, the first end 22 of the inner sub 18 has at least one depression 30 disposed therein for receiving a portion 32 of the semi-flexible tubing 12 forced into the at least one depression 30.

In another embodiment, the first end 22 of the inner sub 18 has a curved end 34 so that the semi-flexible tubing 12 is not damaged by the inner sub 18 when the semi-flexible tubing 12 and the connector apparatus 10 is put under flexion. The curved end 34 curves inward away from an inner surface 35 of the semi-flexible tubing 12. In yet another embodiment, the second end 24 of the inner sub 18 can include a marked indicator 36 (or depression) for use in securing the semi-flexible tubing 12 to the first end 22 of the inner sub 18.

The external sleeve 20 is configured to fit around the semi-flexible tubing 12 and adjacent to the second end 24 of the inner sub 18 that is disposed outside of the semi-flexible tubing 12. The external sleeve 20 includes at least one opening 38 disposed therein that is in general alignment with the at least one depression 30 disposed in the first end 22 of the inner sub 18. The openings 38 in the external sleeve 20 could be threaded and securing devices 40 (e.g., screws, rivets or pins, etc.) could be used to secure the external sleeve 20 to the semi-flexible tubing 12.

In another embodiment, semi-flexible tubing 12 has depressions 42 disposed therein that are generally in alignment with the openings 38 in the external sleeve 20 and the depressions 30 in the first end 22 of the inner sub 18. This permits the securing devices 40 (or other pin-like device, such as a rivet) to extend through the openings 38 in the external sleeve 20 to force the depressions 42 of the semi-flexible tubing 12 to engage (or be forced) into the depressions 30 in the first end 22 of the inner sub 18.

The present disclosure is also directed toward a method of attaching the connector apparatus 10 to the semi-flexible tubing 12. The first end 22 of the inner sub 18 is disposed within the semi-flexible tubing 12. An installation sub 44 is disposed over a portion of the inner sub 18 and the semi-flexible tubing 12 with the first end 22 of the inner sub 18 disposed therein. The installation sub 44 includes at least one extension element 46 extendably attached to the installation sub 44 and a position holding device 48 that is generally aligned with the marked indicator 36 of the second end 24 of the inner sub 18.

The position holding device 48 engages the marked indicator 36 to hold the installation sub 44 in place such that the at least one extension element 46 is generally aligned with the depression 30 disposed on the first end 22 of the inner sub 18. The extension elements 46 are engaged (or forced) into the semi-flexible tubing 12 to create the depressions 42 that are ultimately disposed in the semi-flexible tubing 12. The depressions 42 of the semi-flexible tubing 12 are created by forcing the extension element 46 toward the depressions 30 disposed in the first end 22 of the inner sub 18.

Once the depressions 42 are created in the semi-flexible tubing 12, the installation sub 44 is removed from around the external sleeve 20 and the inner sub 18. The external sleeve 20 is then positioned such that the openings 38 are generally aligned with the depressions 30 in the inner sub 18 and the first end 22 of the inner sub 18. Securing devices 40 can then be used to force the depression 42 of the semi-flexible tubing 12 into the depression 30 disposed on the first end 22 of the inner sub 18.

The present disclosure can also be directed toward a method of using the connector apparatus 10. Fluid can be injected from the surface through the semi-flexible tubing 12 and the connector apparatus 10 to a downhole tool. The downhole tool can be any type of downhole tool known in the art for use with a semi-flexible tubing 12.

From the above description, it is clear that the present disclosure is well adapted to carry out the objectives and to attain the advantages mentioned herein as well as those inherent in the disclosure. While presently preferred embodiments of the disclosure have been described, it will be understood that numerous changes may be made which will readily suggest themselves to those skilled in the art and which are accomplished within the spirit of the disclosure.

What is claimed is:

1. A connector apparatus, the apparatus comprising:

an inner sub having a first end disposable within a semi-flexible tubing and a second end connectable to downhole tools, the first end having at least one depression disposed thereon, the depression disposed on the first end of the inner sub generally alignable with at least one depression disposed on the semi-flexible tubing; and an external sleeve having an inner diameter surface, an outer diameter and a length, the external sleeve disposable outside of the semi-flexible tubing, the external sleeve disposed axially adjacent to the second end of the inner sub and substantially flush in an outward radial direction with the second end of the inner sub, the external sleeve having at least one opening disposed therein generally aligned with the at least one depression in the first end of the inner sub, the external sleeve and the inner sub cooperating to secure the connector apparatus to the semi-flexible tubing, the first end of the inner sub having a first outer surface having a first diameter for engaging the semi-flexible tubing, a second outer surface having a second diameter for engaging the inner diameter surface of the external sleeve, the first diameter less than the second diameter and the second diameter less than an outer diameter of the second end of the inner sub, the outer diameter of the external sleeve being uniform along substantially the length of the external sleeve.

2. The apparatus of claim 1 further comprising at least one securing device for securing the external sleeve and the semi-flexible tubing to the inner sub, the at least one securing device extending through the at least one opening disposed in the external sleeve.

3. The apparatus of claim 2 wherein the at least one securing device forces the depressions disposed in the semi-flexible tubing into the depressions disposed on the inner sub.

4. The apparatus of claim 1 wherein the inner sub has a curved end disposed on the first end.

5. The apparatus of claim 4 wherein the curved end curves inward away from an inner wall of the semi-flexible tubing.

6. The apparatus of claim 1 wherein the inner sub includes a marked indicator to permit predetermined alignment of an installation sub.

7. The apparatus of claim 1 further comprising at least one sealing member disposed between a portion of the inner sub and the semi-flexible tubing.

8. A method, the method comprising:

running a semi-flexible tubing and a downhole tool into a wellbore, the downhole tool supported by the semi-flexible tubing via a connector apparatus, the connector apparatus comprising:

an inner sub having a first end disposed within a semi-flexible tubing and a second end connectable to downhole tools, the first end having at least one depression disposed thereon, the semi-flexible tubing having at least one depression disposed thereon generally aligned with the depression disposed on the first end of the inner sub; and an external sleeve having an inner diameter surface, an outer diameter and a length, the external sleeve disposed outside of the semi-flexible tubing, the external sleeve disposed axially adjacent to the second end of the inner sub and substantially flush in an outward radial direction with the second end of the inner sub, the external sleeve having at least one opening disposed therein generally aligned with the at least one depression in the first end of the inner sub, the external sleeve and the inner sub cooperating to secure the connector apparatus to the semi-flexible tubing, the first end of the inner sub having a first outer surface having a first diameter for engaging the semi-flexible tubing, a second outer surface having a second diameter for engaging the inner diameter surface of the external sleeve, the first diameter less than the second diameter and the second diameter less than an outer diameter of the second end of the inner sub, the outer diameter of the external sleeve being uniform along substantially the length of the external sleeve.

9. The method of claim 8 further comprising at least one securing device for securing the external sleeve and the semi-flexible tubing to the inner sub, the at least one securing device extending through the at least one opening disposed in the external sleeve.

10. The method of claim 9 wherein the at least one securing device forces the depressions disposed in the semi-flexible tubing into the depressions disposed on the inner sub.

11. The method of claim 8 wherein the inner sub has a curved end disposed on the first end.

12. The method of claim 11 wherein the curved end curves inward away from an inner wall of the semi-flexible tubing.

13. The method of claim 8 wherein the inner sub includes a marked indicator to permit predetermined alignment of an installation sub.

14. The method of claim 8 further comprising at least one sealing member disposed between a portion of the inner sub and the semi-flexible tubing.

15. A method, the method comprising:

inserting a portion of an internal sub of a connector apparatus into a semi-flexible tubing;

creating at least one depression in the semi-flexible tubing to engage a first end of the internal sub disposed within the internal sub; and securing an external sleeve of the connector apparatus around a portion of the semi-flexible tubing, the external sleeve having an inner diameter surface, an outer diameter and a length, the external sleeve disposed axially adjacent to the second end of the inner sub and substantially flush in an outward radial direction with the second end of the inner sub, the external sleeve has at least one opening therein generally aligned with the at least one depression created in the semi-flexible tubing, the external sleeve and the internal sub cooperating to secure the connector apparatus to the semi-flexible tubing, the first end of the inner sub having a first outer surface having a first diameter for engaging the semi-flexible tubing, a second outer surface having a second diameter for engaging the inner diameter surface of the external sleeve, the first diameter less than the second diameter and the second diameter less than an outer diameter of the second end of the inner sub, the outer diameter of the external sleeve being uniform along substantially the length of the external sleeve.

16. The method of claim 15 further comprising the step of positioning an installation sub around a portion of the semi-flexible tubing, the installation sub having at least one extension element that can extend inwardly and create the at least one depression in the semi-flexible tubing.

17. The method of claim 16 wherein the external sleeve is secured to the semi-flexible tubing via at least one securing device selectively extendable through the at least one opening disposed in the external sleeve, the securing device engages the at least one depression in the semi-flexible tubing and forces it into the at least one depression disposed in the internal sub.

18. The method of claim 16 wherein the installation sub includes a position holding device that is in general alignment with a marked indicator disposed on a portion of the internal sub to secure the installation sub at a specific orientation and location about the internal sub to allow the at least one extension element to be oriented in a predetermined location with respect to the internal sub.

19. The method of claim 15 further comprising the step of creating at least one depression disposed on the second end of the internal sub generally in alignment with the at least one depression disposed in the semi-flexible tubing.

20. The method of claim 15 wherein a first end of the internal sub has an end that curves inward from an inner wall of the semi-flexible tubing to permit the internal sub to withstand flexion within the semi-flexible tubing.

* * * * *